United States Patent [19]

Watanabe et al.

[11] Patent Number: 4,464,666

[45] Date of Patent: Aug. 7, 1984

[54] MULTIPLE REFLECTOR ANTENNA

[75] Inventors: Fumio Watanabe; Yoshihiko Mizuguchi, both of Tokyo, Japan

[73] Assignee: Kokusai Denshin Denwa Kabushiki Kaisha, Tokyo, Japan

[21] Appl. No.: 366,030

[22] Filed: Apr. 6, 1982

[30] Foreign Application Priority Data

Apr. 27, 1981 [JP] Japan ..... 56-062522

[51] Int. Cl.[3] ..... H01Q 19/19

[52] U.S. Cl. ..... 343/781 P; 343/914; 343/761

[58] Field of Search ..... 343/781 CA, 761, 775, 343/781 R, 781 P, 779, 837, 840, 914

[56] References Cited

U.S. PATENT DOCUMENTS 3,763,493 10/1972 Shimada et al. ..... 343/781 CA
4,042,933 8/1977 Lapp ..... 343/761
4,166,276 8/1979 Dragone ..... 343/837
4,339,757 7/1982 Chu ..... 343/781 P
4,355,314 10/1982 Ohm ..... 343/781 CA

*Primary Examiner*—Eli Lieberman
*Assistant Examiner*—Karl Ohralik
*Attorney, Agent, or Firm*—Pollock, Vande Sande & Priddy

[57] ABSTRACT

A multiple reflector antenna is disclosed that comprises a main reflector formed of a portion of a rotatively symmetrical surface with respect to a rotation axis, a sub-reflector, at least one auxiliary reflector, and at least one wave source, said rotation axis being parallel to or slightly deviated from an aperture plane. This antenna is characterized by such construction that said sub-reflector and auxiliary reflector intentionally cause distortion of an electro-magnetic field distribution to cancel the distortion generated at said main reflector.

4 Claims, 9 Drawing Figures

MULTIPLE REFLECTOR ANTENNA

FIELD OF THE INVENTION

This invention relates to a high performance multiple reflector antenna which is capable of wide range scanning of the antenna beam and is applicable to multi-beam antennas.

DESCRIPTION OF THE PRIOR ART

A conventional antenna of this kind comprises a main reflector 1, 1 sub-reflector 2 and a feed horn (primary radiator) 3 as shown in FIG. 1. It is constructed in off-set form so as to reduce gain drop due to obstacles in the path of the electric wave, and to suppress the amounts of the side lobes.

With an orthogonal coordinate system having its origin 0 on an aperture plane 7, the surface of main reflector 1 is specified as a portion of the trace drawn by a rotation of the cross sectional curve 4 about the y axis, or the y' axis 5 declined by a certain angle in the y-z plane. The antenna whose cross section 4 is given by a parabolic curve is generally called a Torus antenna, and one whose cross section is given by a circle with its center at a point C on the y' axis is called a spherical reflector antenna.

To remove the gain drop due to the spherical aberration of the main reflector 1, a subreflector 2 is provided and its curved surface is so determined as to satisfy the following two conditions:

(1) The length of wave path 8 from point 9 on antenna aperture plane 7 through point 10 on main reflector 1 and point 11 on sub-reflector 2 to focus point 6 which is the phase center of feed horn 3, must be kept constant.
(2) At the point 10 on the main reflector and the point 11 on the sub-reflector, the wave path 8 must satisfy the light reflection law.

The principle of operation of such a conventional antenna will be explained, provided that it is used as a receiving antenna. The electric wave which enters at the point 9 on the aperture plane 7, travels along the wave path 8 shown by a dot-and-dash line, then it is reflected at the point 10 on main reflector 1 and directed to point 11 on sub-reflector 2. Since this main reflector has a spherical aberration, the electric wave reflected at the main reflector 1 does not focus on one point. To remove the spherical aberration, a sub-reflector 2 is provided, which focuses the wave reflected at the main reflector 1 on the phase center (focus) 6 of the feed horn 3.

With a Torus antenna having a main reflector 1 which is rotatively symmetrical with respect to y' axis 5, the sub-reflector 2 and the feed horn 3 can be rotated about the y' axis 5, while keeping their relative position constant, thereby realizing a beam scanning which is free from spherical abberation.

With a spherical main reflector surface 1 having its center at point C, the beam can be scanned by a rotation of the sub-reflector 2 and the feed horn 3 about an arbitrary axis that passes the point C as well as the y' axis.

Incidentally, such factors as aperture efficiency of the reflector antenna, shape of radiated main beam, side-lobe characteristic of the near axis, cross polarization isolation, tracing characteristic in the higher mode tracking system, etc. are determined mainly by the electro-magnetic field distribution over the antenna aperture plane.

In the prior art antenna of FIG. 1 including the feed horn 3 having radiation pattern equi-level lines represented by concentric circles of FIG. 2(*a*), distribution of the electro-magnetic field reflected at the sub-reflector 2 and the main reflector 1 is inevitably distorted on the antenna aperture plane 7 as shown in FIG. 2(*b*). Such distortion of distribution on the antenna aperture plane deteriorates the cross polarization characteristic and tracking characteristic in the higher mode tracking system.

This distortion of distribution shown in FIG. 2(*b*) may be classified into a distortion in the shape of equi-level lines (circles) of FIG. 2(*a*), and a distortion in ratio of the concentric circle radii, or in the amplitude distribution.

The former (a distortion in shape of the equi-level lines) deteriorates the cross polarization characteristic and the tracking characteristic in the higher mode tracking system. In correcting the mirror surface of a ordinary Cassegrain antenna for high efficiency or suppressed side lobes, a certain amount of the latter distortion (amplitude distortion) is intentionally generated to get a desired aperture field distribution. The conventional antenna of FIG. 1, however, has the disadvantage that it can not minimize the former distortion nor have the desired amount of the latter distortion.

In another example of a conventional antenna, the antenna is equipped with an auxiliary reflector in addition to the existing off-set spherical reflector and sub-reflector, so that it can scan the beam with its feed horn fixed. (See Japan laid open application No. SHO 52-73655). Such an auxiliary reflector is either of a curved surface consisting of quadratic curves or of a non-quadratic curve rotated about an axis, passing through the center of a sphere and being parallel to the z axis of FIG. 1. Therefore, the electro-magnetic field distribution over the aperture plane of this antenna will be also distorted as shown in FIG. 2(*b*).

SUMMARY OF THE INVENTION

It is an object of this invention to provide an antenna, being free from the disadvantages that the conventional Torus antenna and the off-set spherical antenna have, and having such desired antenna aperture field distribution as extremely small distortion in shape of the distribution, decreased side lobes and high efficiency.

DETAILED DESCRIPTION OF THE INVENTION

Figure 3:
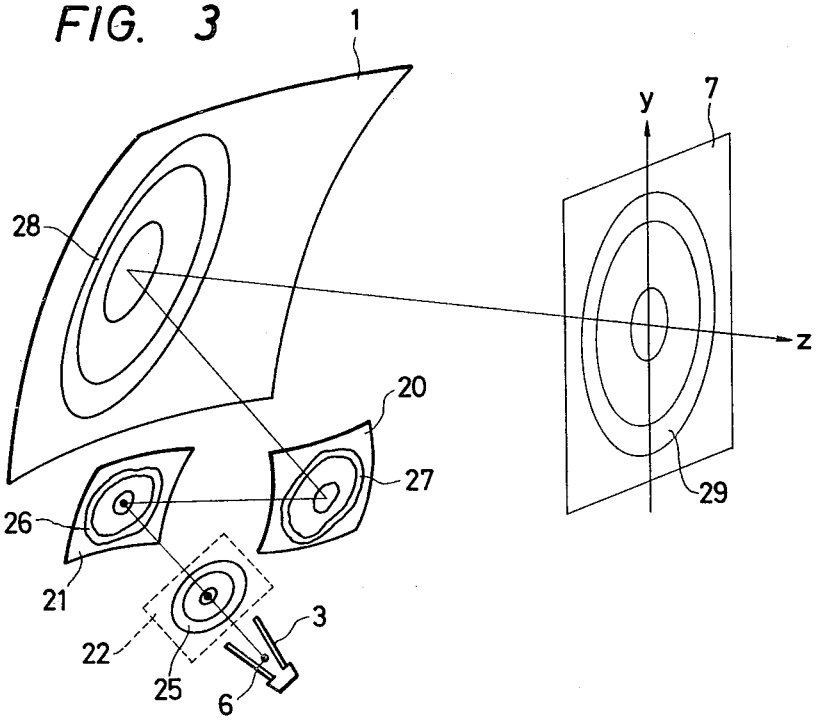
FIG. 3 is a drawing for use in explanation of the principle of realizing desired aperture field distribution according to this invention.

First, the principle of this invention will be explained. The principle of this invention is shown in FIG. 3, where reference number 20 denotes a sub-reflector, number 21 an auxiliary reflector, number 22 an assumed screen, and number 25 denotes radiation field distribution of the feed horn shown by a schematic diagram on the assumed screen 22, and the numbers 26, 27, 28 and 29 denote the electro-magnetic field distribution on the auxiliary reflector 21, sub-reflector 20, main-reflector 1 and aperture plane 7, respectively.

As shown in the figure, the distribution of field from the feed horn 3 is modified at each reflector surface and aperture plane in the course of the travelling of the wave. It is the principle of this invention that the field distribution is intentionally deformed by two reflectors 21 and 20 in order to cancel the distortion generated at the main reflector 1.

Next, an embodiment of this invention will be explained with reference to FIG. 4. In the figure, sub-reflector 20 and auxiliary reflector 21 are formed with non-quadratic curved surfaces that satisfy the above principle. The details of design will be explained hereinafter.

Figure 1:
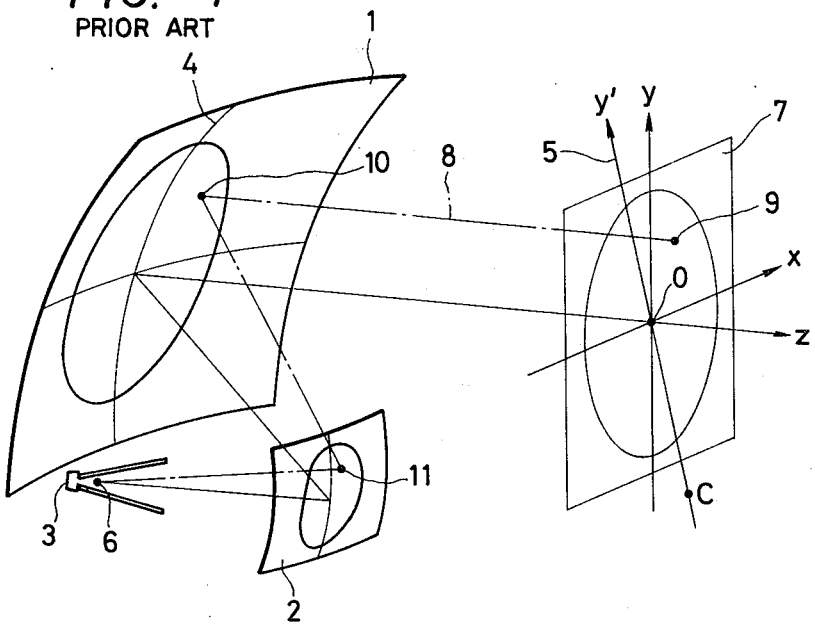
FIG. 1 PRIOR ART
FIG. 1 shows a configuration of an embodiment of the conventional Torus or spherical antenna.

Main reflector 1, sub-reflector 20 and auxiliary reflector 21 should satisfy the conditions (1) through (5) that will be described later in this specification. In FIG. 4, the same reference notations as those in FIG. 1 denote the same parts or concept.

In transmission, with the antenna having such configuration, the electric wave radiated from the feed horn 3 travels along the wave path 14 shown by a dot-and-dash line, being reflected at point 13 on the auxiliary reflector 21, point 12 on the sub-reflector 20 and point 10 on the main reflector 1, and reaches the point 9 on the aperture plane 7.

In reception, the electric wave travels in the opposite direction along the same path. The wave enters at the point 9 on the aperture plane 7, passes through point 10 on the main reflector 1, point 12 on the sub-reflector 20 and point 13 on the auxiliary reflector 21, and finally focuses on the point 6.

With the antenna of this embodiment, each wave path from the focus point 6 to every point on the aperture plane 7 has a constant length, and the reflection law is satisfied at every reflection point on the reflectors, so that there is no aberration.

Since the antenna of this embodiment is so constructed as to follow the above principle, the distortion in shape of the antenna aperture field distribution is extremely minimized.

A method of designing the sub-reflector and auxiliary reflector employed in the above embodiment will now be explained in detail with reference to FIGS. 3 and 4.

The reflector surface must satisfy the following conditions:

(1) The main reflector surface is specified as a portion of a trace drawn by a rotation of cross sectional curve 4 about the y' axis 5.

(2) The total length of wave path 14, from the phase center 6 of the feed horn 3 through point 13 on the auxiliary reflector 21, point 12 on the sub-reflector 20 and point 10 on the main reflector 1 to the point 9 on the aperture plane 7, must be kept constant.

(3) The straight line connecting the two points 10 and 9 must be parallel to the Z axis.

(4) The light reflection law must be satisfied at points 13, 12, 10 on the reflectors.

(5) Under predetermined radiation field distribution of the feed horn 3 and desired antenna aperture field distribution, the field distribution 29 over the aperture plane 7 must perfectly coincide with the aimed distribution on the y axis and must well approximate it on the other parts.

A shape of the reflector surface satisfying these conditions may be determined by solving a differential equation and optimization problem.

The above conditions (1)–(4) will be explained, referring to formulae. Vectors indicated by the arrows drawn from the origin 0 to the phase center 6 of the feed horn 3, to point 13 on the auxiliary reflector 21, to point 12 on the sub-reflector 20 and to point 10 on the main reflector 1, respectively, are represented by $\vec{FO}$, $\vec{B}$, $\vec{S}$ and $\vec{M}$ as shown in FIG. 4. In the following explanation, the notation→represents a vector.

According to the condition (1), the surface of the main reflector 1 is a portion of a rotation trace whose rotation axis is the y' axis. Therefore, the vector $\vec{M}$ is represented generally by the following equation (1), provided that the cross sectional curve 4 is $$z' = g(y')$$

on y'-z' coordinates.

$$\vec{M} = \begin{vmatrix} x_m \\ y_m \\ z_m \end{vmatrix} = \begin{vmatrix} -g(t)\cos\eta \\ g(t)\cos\eta\sin\alpha + t\cos\alpha \\ g(t)\cos\eta\cos\alpha - t\sin\alpha \end{vmatrix} \quad (1)$$

where, t and $\eta$ are parameters for expressing a curved surface and $\alpha$ is an angle between two axes y and y'.

The unit normal $\vec{n}_M$ of the main reflector 1 is represented by equation (2):

$$\vec{n}_M = \frac{1}{\sqrt{1 + \left(\frac{dg}{dt}\right)^2}} \begin{vmatrix} -\sin\eta \\ \cos\eta\sin\alpha - \frac{dg}{dt}\cos\alpha \\ \cos\eta\cos\alpha + \frac{dg}{dt}\sin\alpha \end{vmatrix} \quad (2)$$

If the surface of the main reflector 1 has a spherical shape with its radius Ro centered at the point C ($y' = t_c$, $z' = 0$) on y' axis, function g(t) is represented by the following equation:

$$g(t) = -\sqrt{R_o^2 - (t - t_c)^2} \quad (3)$$

Figure 4:
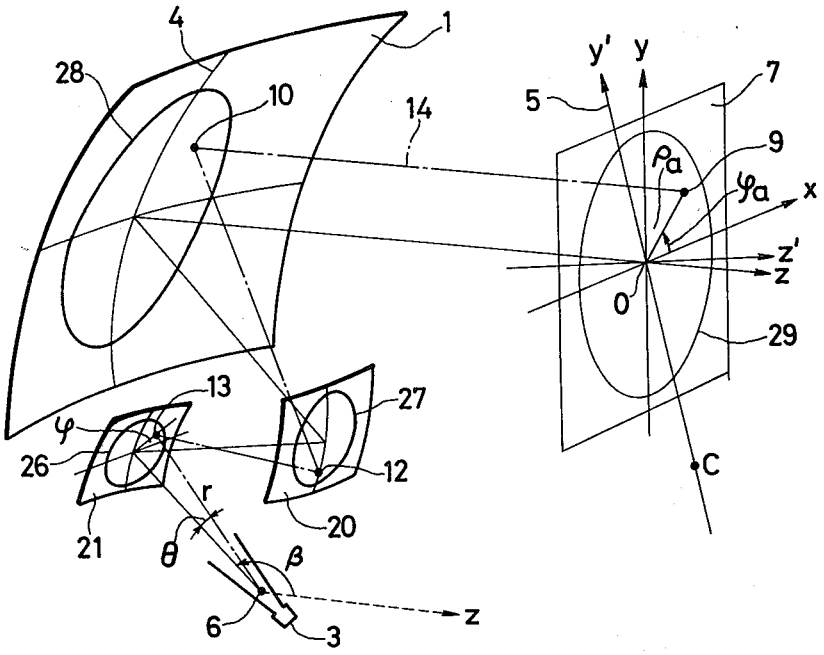
FIG. 4 shows a first embodiment of the antenna according to this invention.

The curved surface of the auxiliary reflector 21 may be represented by the following equation, using polar coordinates with its origin at point 6 as shown in FIG. 4, because a more general reflector surface than the conventional one is used in this embodiment.

$$r = f(\theta, \phi) \quad (4)$$

The f ($\theta$,$\phi$) is determined by the condition (5) as will be explained hereinafter.

The Vector $\vec{B}$ representing the straight line between the origin 0 and the point 13 on the auxiliary reflector 21 and the unit normal $\vec{n}_B$ of the auxiliary reflector 21 are expressed, respectively, by the following equations (5) and (6):

$$\vec{B} = \begin{vmatrix} x_b \\ y_b \\ z_b \end{vmatrix} = \vec{F_o} + r \begin{vmatrix} \sin\theta\cos\phi \\ \sin\theta\sin\phi\cos\beta + \cos\theta\sin\beta \\ -\sin\theta\sin\phi\sin\beta + \cos\theta\cos\beta \end{vmatrix} \tag{5}$$

$$\vec{n_B} = \frac{1}{\sqrt{\left(\frac{\partial r}{\partial\theta}\right)^2 + \left(\frac{1}{\sin\theta}\ \frac{\partial r}{\partial\phi}\right)^2 + r^2}} \cdot \tag{6}$$

$$\begin{vmatrix} -\cos\theta\cos\phi & -\sin\phi & \sin\theta\cos\phi \\ -\cos\theta\sin\phi\cos\beta + \sin\theta\sin\beta & -\cos\phi\cos\beta & \sin\theta\sin\phi\cos\beta + \cos\theta\sin\beta \\ \cos\theta\sin\phi\sin\beta + \sin\theta\cos\beta & \cos\phi\sin\beta & -\sin\theta\sin\phi\sin\beta + \cos\theta\cos\beta \end{vmatrix} \cdot \begin{vmatrix} \frac{\partial r}{\partial\theta} \\ \frac{1}{\sin\theta}\ \frac{\partial r}{\partial\phi} \\ r \end{vmatrix}$$

Where, $\beta$ is an angle between vertex axis of the polar coordinates with its origin at the point 6 and the z axis.

Since the wave path extending from the point 9 on the aperture plane 7 to the main reflector 1 is parallel to the z axis (said condition (3)), the unit vector $R_M$ directed from the point 10 on the main reflector 1 to the point 12 on the sub-reflector 20 is given by equation (7), because of the reflection law applied at the point 10 (said condition (4)):

$$\vec{R_M} = -\vec{k} + 2(\vec{n_M}\cdot\vec{k})\vec{n_M} \tag{7}$$

where, k is a unit vector in z direction.

Similarly, the unit vector $\vec{R_B}$ directed from point 13 on the auxiliary reflector 21 to the point 12 is given by equation (8):

$$\vec{R_B} = \vec{I_B} - 2(\vec{n_B}\cdot\vec{I_B})\vec{n_B} \tag{8}$$

where, $$\vec{I_B} = \frac{\vec{B} - \vec{F_o}}{r}$$

Moreover, the vectors $\vec{S}$ representing the straight line from the origin 0 to the point 12 on the sub-reflector 20 is given by equation (9), provided that $\lambda_M$ is the length of the wave path lying between point 10 on the main reflector 1 and point 12 on the sub-reflector 20, and $\lambda_B$ is the length of the wave path between the point 13 on the auxiliary reflector 21 and the point 12.

$$\begin{aligned} \vec{S} &= \vec{M} + \lambda_M\vec{R_M} \\ &= \vec{B} + \lambda_B\vec{R_B} \end{aligned} \tag{9}$$

If the length of the wave path between point 9 on the aperture plane 7 and point 10 on the main reflector surface 1 is given by $\lambda_A$, said condition (2) that the total length of wave path 14 is kept constant lo, leads to the following equation (10):

$$l_o = \lambda_A\lambda_M + \lambda_B + r \tag{10}$$

With a predetermined main reflector 1 and auxiliary reflector 21, or given functions g(t) and f($\theta,\phi$), the vector $\vec{S}$ is obtained by solving equations (9) and (10) to determine the surface of the sub-reflector 20. The equations (9) and (10) form simultaneous equations including four variables t, $\eta$, $\lambda_M$ and $\lambda_B$, plus independent variables $\theta$ and $\phi$, or the equations including four variables $\theta$, $\phi$, $\lambda_M$ and $\lambda_B$, plus independent variables t and $\eta$.

Next, an explanation will be made about how to determine the curved surface f($\theta$, $\phi$) of the auxiliary reflector 21 under said condition (5). The f($\theta$, $\phi$) is determined in the following two step operations:

(a) To get exact agreement of the aperture field distribution to a desired distribution in connection with the y axis of the antenna aperture plane 7, the curves within (y-z) cross section, i.e., f($\theta$, $\pi/2$) and f($\theta$,$-\pi/2$), are determined by using an ordinary differential equation.

Since the cross sectional curve 4 of the main reflector 1, g(t), as described hereinbefore, is predetermined to be hyperbola or circle, f($\theta$,$\pm\pi/2$) can be obtained in the same way as that in the surface correction technique of an ordinary Cassegrain antenna when a desired aperture field distribution and a radiation pattern of a feed horn are given.

(b) The curved surface of the part other than the (y-z) cross section of the auxiliary reflector can be determined by the following procedure:

Using f($\theta$,$\pi/2$), f($\theta$,$-\pi/2$) obtained in the step (a), f($\theta$, $\phi$) can be expressed as follows:

$$f(\theta,\phi) = f_o(\theta,\phi) + f_c(\theta,\phi) \tag{11}$$

where $$f_o(\theta,\phi) = \frac{2}{\frac{1}{f\left(\theta,\frac{\pi}{2}\right)} + \frac{1}{f\left(\theta,-\frac{\pi}{2}\right)} + \sin\phi\left(\frac{1}{f\left(\theta,\frac{\pi}{2}\right)} - \frac{1}{f\left(\theta,-\frac{\pi}{2}\right)}\right)} \tag{12}$$

$$f_c(\theta,\phi) = \sum_{n=1}^{N}\sum_{m=0}^{M} a_{nm}(\sin\theta)^{2n+m}\cos^{2n}\phi\sin^m\phi \tag{13}$$

Equation (13) gives the partial sum of the Taylor expansion with respect to spherical coordinates, in which $a_{nm}$ represents a coefficient of the n th and m th term. f($\theta$, $\phi$) may be expressed by any other finite function series which is equal to $f(\theta, \pi/2)$ and $f(\theta, -\pi/2)$ obtained by the step (a) and includes finite number of coefficients.

The value of the coefficient $a_{nm}$ is adopted such that the field distribution of the aperture plane gives the closest approximation to the desired one. In practice, $a_{nm}$ can be determined by use of the optimization procedure. As an objective function $\epsilon$, which is a function of coefficients $a_{nm}$ to be minimized, we can use the following equation (14) for example:

$$\epsilon = \int\int (E(\rho a, \phi a) - Ed(\rho a, \phi a))^2 \rho a d\rho a d\phi a \tag{14}$$

where, $Ed(\rho a, \phi a)$ represents a desired aperture field distribution, and $E(\rho a, \phi a)$ represents an actual field distribution of the reflector system. $E(\rho a, \phi a)$ of the above equation is expressed by the following using the radiation pattern of the feed horn 3 $Ep(\theta, \phi)$:

$$E(\rho_a, \phi_a) = Ep(\theta, \phi)\sqrt{\frac{K \sin\theta}{\rho_a \left| \frac{\partial(\rho_a, \phi_a)}{\partial(\theta, \phi)} \right|}} \tag{15}$$

where $$K = \frac{\int_0^{2\pi}\int_0^{\theta_m} E^2(\rho_a, \phi_a)\rho_a \left| \frac{\partial(\rho_a, \phi_a)}{\partial(\theta, \phi)} \right| d\theta d\phi}{\int_0^{2\pi}\int_0^{\theta_m} E_p^2(\theta, \phi)\sin\theta d\theta d\phi}$$

The parameter $\theta m$ is half of the angle viewing the auxiliary reflector 21 from the phase center 6 of the feed horn.

As mentioned before, the relation between $(\theta, \phi)$ and $(\rho a, \phi a)$ can be obtained by solving the simultaneous equations (9) and (10), so we can calculate $E(\rho a, \phi a)$ by the equation (15).

The objective function for the optimization problem is not confined to equation (14), but next equation (16) can also be used, $$\epsilon = \int_0^{2\pi}\int_0^{\theta_m} \{(x_m - x_{mo})^2 + (y_m - y_{mo})^2\}\sin\theta d\theta d\phi \tag{16}$$

where, (Xm, Ym) is a coordinate point 9 at which the wave path 14 (along which the wave from the focus 6 travels with angles $\theta$ and $\phi$) crosses the aperture plane 7, and (Xmo, Ymo) is its desired coordinate point, which is determined by the relation between $Ep(\theta, \phi)$ and $Ed(\rho a, \phi a)$.

If the aperture field distribution gives a complete agreement to the aimed distribution, the objective function given by equation (14) or (16) will be equal to zero.

In the foregoing surface design method, an example is shown in which the function of the surface of auxiliary reflector 21 is expanded as shown in equations (11)–(13). It is, however, apparent that the same design procedure is applicable to the functional expansion of the surface of sub-reflector 20.

Figure 6:
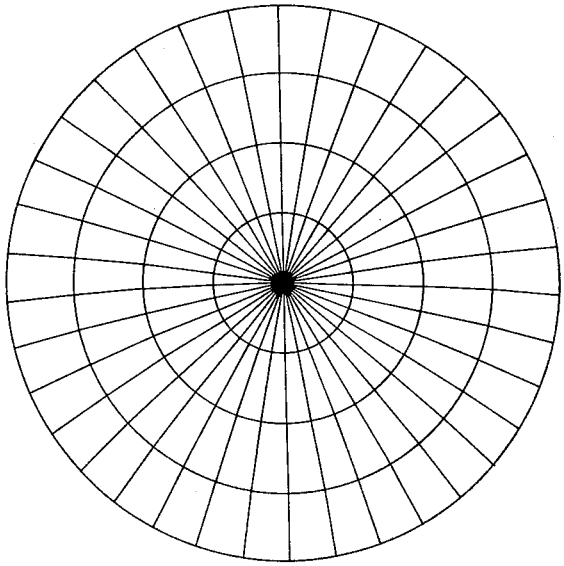
FIG. 6 is a drawing for use in explanation of antenna aperture field distribution in said first embodiment.

An embodiment of an antenna designed in accordance with said reflector surface design method will be explained, with reference to FIGS. 5 and 6 and tables 1 and 2.

Figure 5:
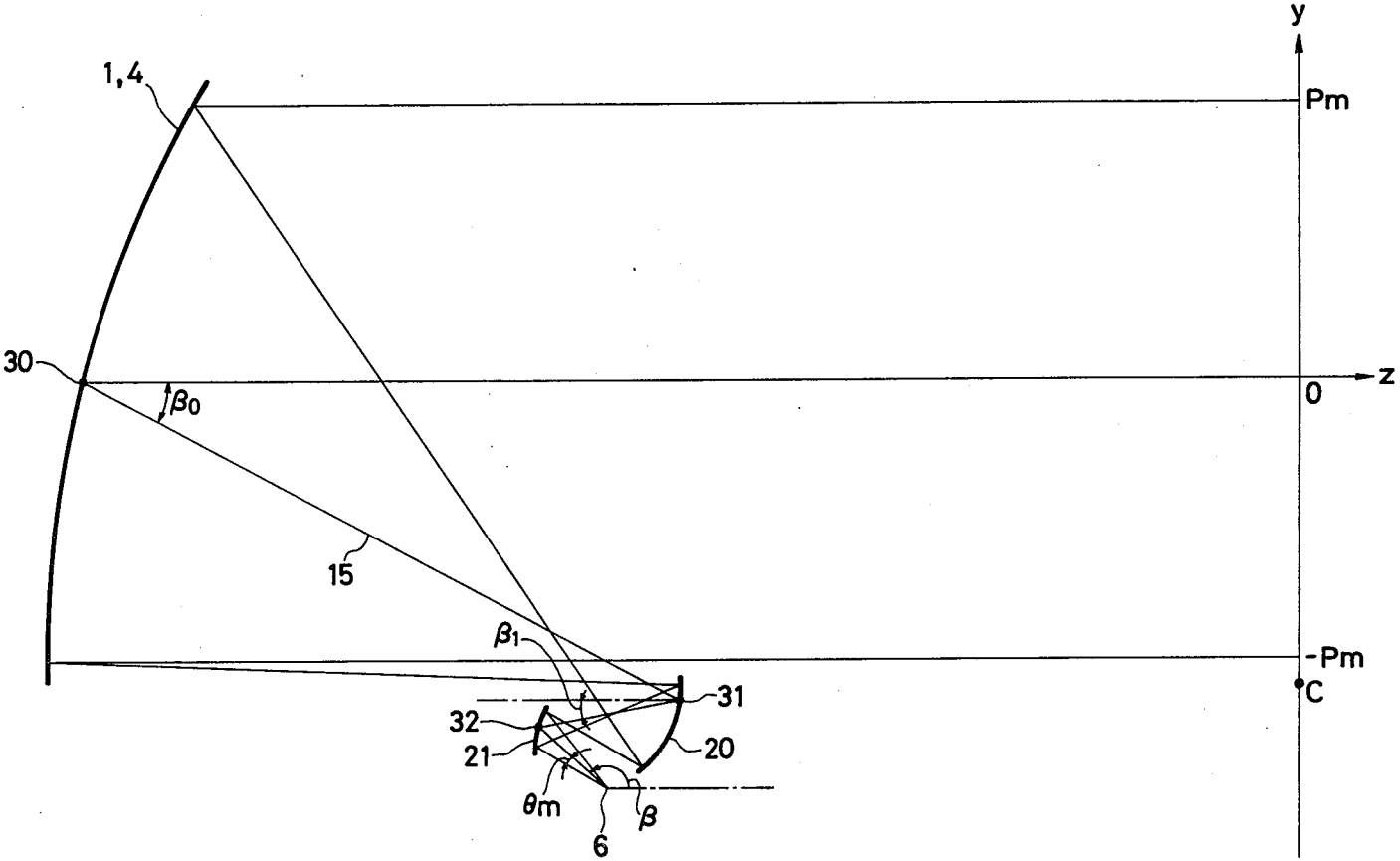
FIG. 5 is a cross sectional view of an antenna designed in accordance with the present invention.

FIG. 5 shows a (y-z) cross section of an antenna, in which the main reflector 1 has a spherical surface with its center at point C. Such points on central wave path 15 as point 32 on the auxiliary reflector 21, point 31 on the sub-reflector 20 and point 30 on the main reflector 1 have the coordinates given below.

| | |
|---|---|
| point 30 | (0, 0, −1) |
| point 31 | (0, −0.2634, −0.5046) |
| point 32 | (0, −0.2843, −0.6228) |
| point 6 | (0, −0.3357, −0.5615) |

Values of $\beta_0$, $\beta_1$ and $\beta_2$ are 28°, 10° and 140°, respectively. Furthermore, the parameters $\theta$, $\rho a$ are assumed to satisfy the relation $$\frac{\rho_a}{\rho_m} = \frac{\theta}{\theta_m}.$$

Then, the desired aperture field distribution $Ed(\rho a, \phi a)$ is given by the following equation (17):

$$Ed(\rho_a, \phi_a) = K\, Ep(\theta)\sqrt{\frac{\sin\theta}{\rho_a}} \tag{17}$$

where, $\rho m$ stands for an antenna aperture radius and its value may be 0.23. The value of $\theta m$ may be 10°.

The curves $f(\theta, \pi/2)$ and $f(\theta, -\pi/2)$ within (y-z) cross section of auxiliary reflector 21 determined in accordance with said design procedure (a) under said condition is listed in table 1.

TABLE 1

| $\phi$[deg] | $\theta$[deg] | $f(\theta,\phi)$ | $y_b$ | $z_b$ | $y_s$ | $z_s$ |
|---|---|---|---|---|---|---|
| — | 10.00 | .085115 | −.270471 | −.616198 | −.319656 | −.533636 |
| −90.0 | 8.75 | .084740 | −.271962 | −.617360 | −.309883 | −.525399 |
| | 7.50 | .084256 | −.273553 | −.618410 | −.300669 | −.519073 |
| | 6.25 | .083684 | −.275223 | −.619355 | −.292224 | −.514310 |
| | 5.00 | .083038 | −.276956 | −.620204 | −.284662 | −.510802 |
| | 3.75 | .082335 | −.278738 | −.620963 | −.278026 | −.508282 |
| | 2.50 | .081586 | −.280554 | −.621639 | −.272306 | −.506526 |
| | 1.25 | .080805 | −.282394 | −.622240 | −.267457 | −.505346 |
| | .00 | .080000 | −.284250 | −.622771 | −.263412 | −.504594 |
| 90.0 | 1.25 | .079180 | −.286112 | −.623238 | −.260091 | −.504149 |
| | 2.50 | .078351 | −.287976 | −.623648 | −.257405 | −.503918 |
| | 3.75 | .077521 | −.289834 | −.624003 | −.255266 | −.503830 |
| | 5.00 | .076692 | −.291684 | −.624310 | −.253584 | −.503831 |
| | 6.25 | .075870 | −.293522 | −.624571 | −.252273 | −.503886 |
| | 7.50 | .075056 | −.295345 | −.624789 | −.251249 | −.503060 |
| | 8.75 | .074253 | −.297152 | −.624967 | −.250433 | −.504066 |
| | 10.00 | .073463 | −.298941 | −.625108 | −.249749 | −.504173 |

$\rho_m = 0.23$, $\theta_m = 10°$

In table 1, $y_b$ and $z_b$ are coordinate values of the cross section of auxiliary reflector 21 calculated with equation (5), and $y_s$ and $z_s$ are coordinate values of the cross section of sub-reflector 20 calculated with equations (9) and (10) substituted with said values $y_b$ and $z_b$.

The curved surface of the auxiliary reflector 21 designed in accordance with the method explained in the design procedure (b) are represented by equations (11), (12) and (13).

Values of the expansion coefficient $a_{nm}$ of equation (13) are tabulated in table 2, with N=2, and M=3.

TABLE 2

| | |
|---|---|
| $a_{10}$ | 0.01734 |
| $a_{11}$ | −0.02967 |
| $a_{12}$ | 0.08213 |
| $a_{20}$ | 0.06052 |
| $a_{21}$ | −0.05824 |
| $a_{22}$ | −0.05455 |

Figure 2A:
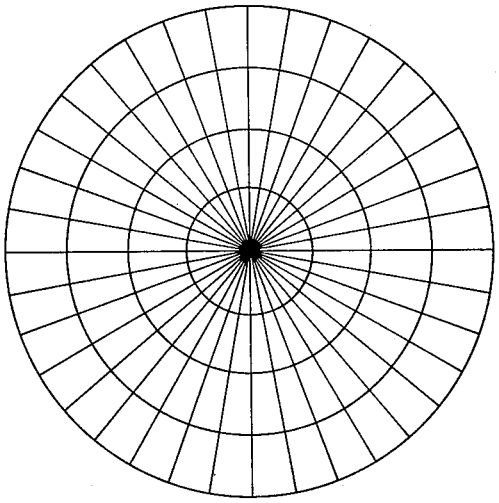
FIGS. 2(*a*) and 2(*b*) are drawings for use in explanation of conventional antenna aperture field distribution.
Figure 2B:
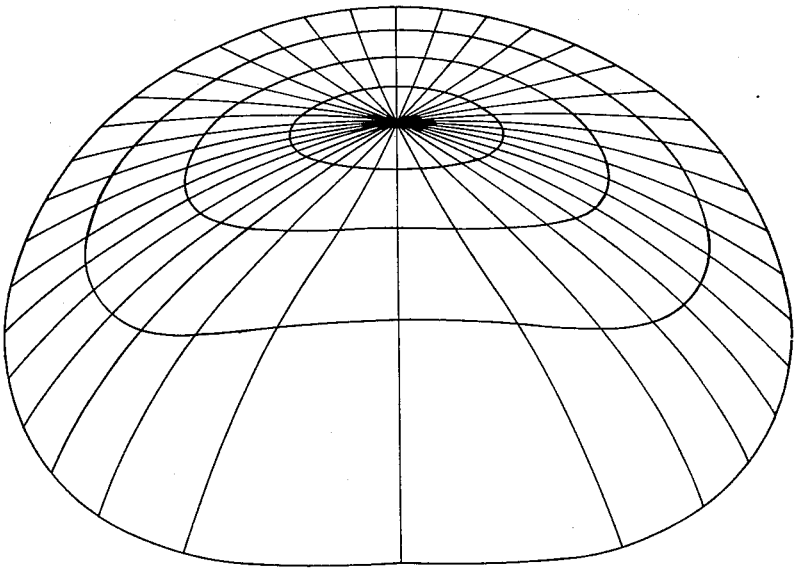

The antenna of the embodiment described above is constructed with a combination of special reflector surfaces where the aberration and distortion introduced at the main reflector are cancelled by the sub-reflector and auxiliary reflector. Therefore, the distribution on the aperture plane 7 of this antenna will be in the shape of almost concentric circles as shown in FIG. 6, provided that the radiation pattern of the feed horn 3 is represented by equi-level lines of concentric circles as shown in FIG. 2(*a*). It is evident by comparison of FIG. 2(*b*) and FIG. 6 that the antenna of this embodiment has much reduced distortion compared with a conventional antenna of this kind.

The, minimization of distribution distortion leads to an improvement of cross polarization characteristic and tracking characteristic in the higher mode tracking system.

As the main reflector in this embodiment has a spherical surface, the feed horn 3 and two reflectors 20 and 21 can be rotated about the center C of the sphere, while their mutual positions are kept unchanged. Therefore, it is not necessary to move the main reflector 1 in order to scan the antenna radiation beam.

Figure 7:
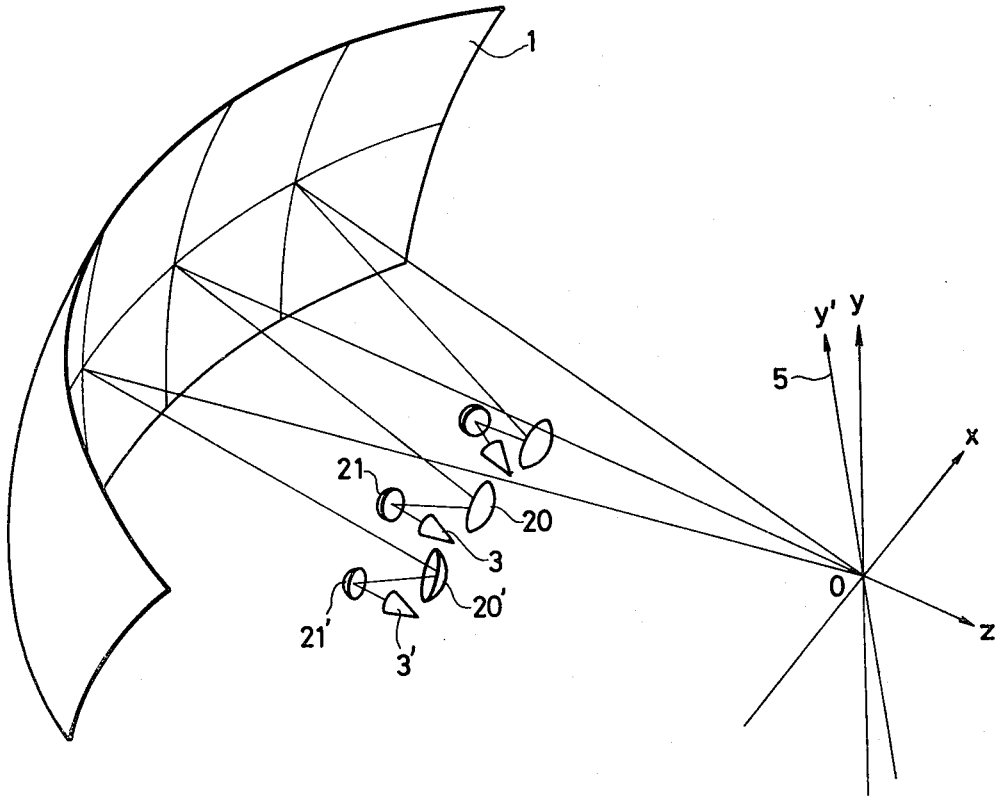
FIG. 7 shows a second embodiment of the antenna according to this invention.

FIG. 7 shows an embodiment of a multiple reflector antenna of this invention used as a multi-beam antenna. Since the main reflector 1 has a surface whose shape is drawn by a rotation of a curve about y' axis 5, plural sets of feed horns 3, 3' and reflectors 20, 20' and 21, 21' placed around rotation axis y' produce a plurality of antenna beams. Moreover, every antenna beam is able to scan individually.

In this embodiment, the desired aperture field distribution for each antenna beam can be set different from others in order to construct a multi-beam antenna having a different shape of antenna beam.

Figure 8:
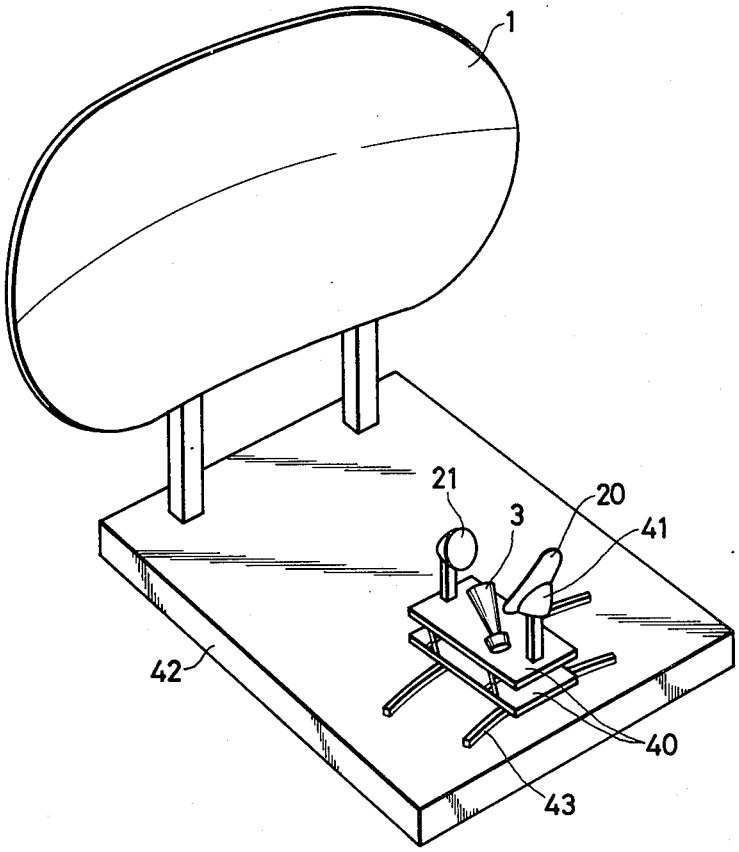
FIG. 8 is a perspective view of an antenna apparatus including an antenna produced in accordance with this invention.

FIG. 8 shows a configuration of antenna apparatus wherein the antenna has its main reflector surface shaped as a sphere according to this invention.

In the figure, the reference number 40 denotes a movable member of a feed portion including feed horn 3, auxiliary reflector 21 and sub-reflector 20, the number 41 denotes a movable support of sub-reflector 20, number 42 a supporting deck, and the number 43 denotes rails along which the movable member 40 moves. The movable member 40 is used for rotating the entire feeder around the center of the sphere which forms a spherical reflector, and consists of a mechanism for making a rotation in a plane parallel to the supporting deck 42 and a mechanism making another rotation in another plane perpendicular to it.

To rotate the entire feeder in the direction parallel to the supporting deck 42, the rails 43 are used as the guide.

The attitude of the sub-reflector 20 is adjusted slightly at the movable supporting deck 41. Although this way of adjustment will cause deterioration of the antenna characteristic e.g., by introduction of aberration, it is still available for some applications because of its simplicity. In the figure, the supporting deck 42 is installed horizontal, but it may be installed at an arbitrary angle.

As described above, the multi-reflector antenna of this invention has such structure that the aberration and distortion introduced at the main reflector is cancelled by the sub-reflector and the auxiliary reflector, therefore the electro-magnetic field distribution over the antenna aperture surface can be shaped well.

This antenna, therefore, has the advantage that the field distribution over the aperture surface is very much less distorted. Because of this advantage, this antenna has a better cross polarization characteristic and tracking characteristic in the higher mode tracking systems than the conventional antenna of this kind. Since the amplitude distribution on the aperture surface can attain complete agreement with a desired distribution within one cross section, we can obtain a low side-lobe level, high gain antenna. Furthermore, since the antenna of this invention has an off-set type structure, it has excellent gain and side-lobe features.

Because of the above mentioned features, the antenna of this invention can track a satellite without moving the large caliber main reflector, consequently it stands well against a strong wind in case it is used as an earth station antenna for a satellite communication system.

What we claim is:

1. A multiple reflector antenna comprising:

a main reflector formed of a portion of rotatively symmetrical surface with respect to a rotation axis, a sub-reflector, at least one auxiliary reflector, and at least one wave source;

said axis being so constructed as to be parallel to or slightly deviated from the antenna aperture plane, and characterized in that said sub-reflector and auxiliary reflector are designed by the following procedure: first a coordinate system having its origin on the aperture surface is defined, and next a vector $\vec{S}$ representing a path from said origin to a point on said sub-reflector and a vector $\vec{B}$ representing a path from said origin to a point on said auxiliary reflector are defined, said vectors $\vec{B}$ and $\vec{S}$ being given by equations (1) and (2) below, function $f(\theta, \phi)$ included in said equations (1) and (2) is substantially determined by the solution of extremal value problem of a functional which is related to a function $f(\theta, \phi)$ representing a difference between a desired value and the actual value of the aperture field distribution at said antenna aperture plane, $$\vec{B} = \vec{F_O} + f(\theta,\phi) \begin{vmatrix} \sin\theta\cos\phi \\ \sin\theta\sin\phi\cos\beta + \cos\theta\sin\beta \\ -\sin\theta\sin\phi\sin\beta + \cos\theta\cos\beta \end{vmatrix}. \tag{1}$$

$$\vec{S} = \vec{B} + [l_O - \lambda_A - \lambda_M - f(\theta,\phi)]\vec{R}_B \tag{2}$$

where $$\vec{R}_B = \vec{I}_B - 2(n_B \cdot \vec{I}_B)n_B$$

$$\vec{I}_B = \frac{\vec{B} - \vec{F_O}}{f(\theta,\phi)}$$

$$\vec{n}_B = \frac{1}{\sqrt{\left(\frac{\partial f(\theta,\phi)}{\partial\theta}\right)^2 + \left(\frac{1}{\sin\theta}\cdot\frac{\partial f(\theta,\phi)}{\partial\phi}\right)^2 + f^2(\theta,\phi)}} \times$$

$$\begin{vmatrix} -\cos\theta\cos\phi & \sin\phi & \sin\theta\cos\phi \\ -\cos\theta\sin\phi\cos\beta + \sin\theta\sin\beta & -\cos\phi\cos\beta & \sin\theta\sin\phi\cos\beta + \cos\theta\sin\beta \\ \cos\theta\sin\phi\sin\beta + \sin\theta\cos\beta & \cos\phi\sin\beta & -\sin\theta\sin\phi\sin\beta + \cos\theta\cos\beta \end{vmatrix}.$$

-continued $$\begin{vmatrix} \dfrac{\partial f(\theta,\phi)}{\partial \theta} \\ \dfrac{1}{\sin\theta} \cdot \dfrac{\partial f(\theta,\phi)}{\partial \phi} \\ f(\theta,\phi) \end{vmatrix}$$

where, $\overrightarrow{FO}$ is a vector of a path from the origin to the focus of the feed horn, $\theta$ and $\phi$ are, respectively, zenith angle and azimuth angle in a polar coordinates with its center at the focus of the feed horn and zenith direction toward the center of the auxiliary reflector, $\beta$ is an angle between the zenith axis of said polar coordinates and the wave path from said main reflector to the aperture plane, $l_o$ is the length of wave path from wave source through auxiliary reflector, sub-reflector and main reflector to the antenna aperture plane, $\lambda_M$ is the wave path from the sub-reflector to the main reflector, and $\lambda_A$ is the wave path from the main reflector to the antenna aperture plane.

2. A multiple reflector antenna according to claim 1, characterized in that plural sets of said sub-reflector, auxiliary reflector and wave source are arranged around said rotation axis.

3. A multiple reflector antenna according to claim 1, characterized in that said combination of sub-reflector, auxiliary reflector and wave source are rotatable in a body around said rotation axis.

4. A multiple reflector antenna according to claim 2, characterized in that said combination of sub-reflector, auxiliary reflector and wave source are rotatable in a body around said rotation axis.

* * * * *